United States Patent [19]

Retallick et al.

[11] Patent Number: 4,938,853

[45] Date of Patent: Jul. 3, 1990

[54] ELECTROLYTIC METHOD FOR THE DISSOLUTION OF COPPER PARTICLES FORMED DURING ELECTROLESS COPPER DEPOSITION

[75] Inventors: Richard C. Retallick, Stamford; Peter E. Kukanskis, Woodbury, both of Conn.

[73] Assignee: MacDermid, Incorporated, Waterbury, Conn.

[21] Appl. No.: 350,148

[22] Filed: May 10, 1989

[51] Int. Cl.[5] ..... C25B 1/00; C23C 18/54; C23C 18/38

[52] U.S. Cl. ..... 204/86; 204/93; 204/96; 204/140; 427/98; 427/305; 427/345; 427/443.1

[58] Field of Search ..... 204/93, 96, 106, 140, 204/86; 427/98, 443.1, 305, 345

[56] References Cited

U.S. PATENT DOCUMENTS

| | | | |
|---|---|---|---|
| Re. 31,694 | 10/1984 | Slominski et al. | 427/443.1 |
| 4,209,331 | 6/1980 | Kukanski et al. | 106/1.23 |
| 4,265,943 | 5/1981 | Goldstein et al. | 427/305 |
| 4,459,184 | 7/1984 | Kukanskis | 204/30 |
| 4,671,968 | 6/1987 | Slominski | 427/12 |
| 4,719,128 | 1/1988 | Krulik | 427/443.1 |

OTHER PUBLICATIONS

Kinoshita et al., *Stoichiometry of Anodic Copper Dissolution at High Current Densities*, J. Electrochemical Soc., vol. 117, No. 10 (Oct. 1970).

*Primary Examiner*—John F. Niebling
*Assistant Examiner*—David G. Ryser
*Attorney, Agent, or Firm*—St.Onge Steward Johnston & Reens

[57] ABSTRACT

Non-adherent copper metal particles ("fines") formed in a plating bath during the course of autocatalytic electroless copper deposition onto activated substrate surfaces are oxidized and redissolved in the bath by brief application of current between an anode element and a cathode element immersed in the bath, the anode element being comprised of an anode surface substantially parallel and proximate to the bottom surface of the vessel containing the bath.

17 Claims, 2 Drawing Sheets

ELECTROLYTIC METHOD FOR THE DISSOLUTION OF COPPER PARTICLES FORMED DURING ELECTROLESS COPPER DEPOSITION

BACKGROUND OF THE INVENTION

The present invention relates to the electroless deposition of copper onto a substrate surface and, more particularly, to a method for carrying out such depositing in a manner which minimizes the build-up of non-adherent copper metal in the depositing or plating bath.

It is well-known that copper can be deposited electrolessly onto suitably catalyzed conductive and non-conductive surfaces by means of aqueous plating baths containing a soluble source of copper ions (e.g., copper salt), a reducing agent, a complexing agent, and pH adjusting agents. The action of the reducing agent on the dissolved copper ions in the presence of the suitably catalyzed (activated) substrate brings about deposition of copper metal onto the surfaces.

Typical early-vintage electroless copper depositing baths relied upon formaldehyde as the reducing agent, and are still in widespread use today notwithstanding recognized potential problems relating to toxicity of formaldehyde vapors. A significant advance in the art was achieved in U.S. Pat. No. 4,209,331 which describes formaldehyde-free electroless copper depositing solutions based upon hypophosphite reducing agents.

The formaldehyde-reduced electroless copper baths are "autocatalytic", i.e., once a copper layer is electrolessly deposited therefrom onto the activated substrate surface, the deposited layer serves to catalyze yet further deposition. This is a desirable feature of electroless plating baths since it permits the build-up of copper on substrate surfaces to substantial thicknesses dictated solely by maintenance of plating conditions and bath concentrations for predetermined periods of time.

In contrast, the hypophosphite-reduced electroless copper baths such as described in U.S. Pat. No. 4,209,331 are non-autocatalytic, i.e., once the activated substrate has been coated with a thin layer of the deposited copper, the deposition reaction stops or becomes uneconomically slow. It is known, however, that hypophosphite-reduced electroless copper baths can be modified compositionally and/or via process techniques, to achieve desirable "autocatalytic" plating. For example, in U.S. Pat. No. 4,459,184, an inherently non-autocatalytic hypophosphite-reduced electroless copper bath (such as described in U.S. Pat. No. 4,209,331) is first used to produce on the activated substrate the thin copper deposit possible with such baths. Thereafter, an electrical current of negative potential is continuously applied to the substrate workpiece to bring about additional copper deposition, essentially in the nature of an electroplating process using an electroless plating bath.

In U.S. Pat. No. 4,265,943, an otherwise non-autocatalytic hypophosphite-reduced electroless copper bath is rendered autocatalytic by inclusion in the bath of sources of non-copper ions (e.g., cobalt and/or nickel ions) which serve as autocatalysis promoters. In U.S. Pat. No. 4,671,968, it was taught that the baths of U.S. Pat. No. 4,265,943 do not in fact operate autocatalytically in many situations (e.g., in the attempted plating of non-conductive surfaces of through-holes formed in a copper-clad printed circuit board substrate), but can be made to do so by briefly applying to the workpiece an electric current of negative potential, whereafter the applied potential is terminated and the initiated electroless plating then continues autocatalytically.

By their very nature, electroless copper baths which are inherently autocatalytic, or which are operated in a way so as to render them autocatalytic in use, can cause difficulties in the plating process During the course of plating of the suitably activated substrate surfaces of the workpiece, copper metal may also (undesirably) deposit on non-workpiece areas. One means by which this occurs is by virtue of minute impurities (e.g., dirt particles) present in the bath which can serve essentially as minute "substrates" for copper metal deposited from the bath. Copper which adheres to such impurities generally will not adhere to the workpiece surface and thus tends to accumulate in the plating vessel. By reason of autocatalysis, these initially minute copper particles act as seeds or nucleation sites for still further build-up of copper thereon, to the point where, over the course of the plating process or multiple plating processes using the bath, they can grow to fairly substantial size and in fairly substantial numbers. As these particles grow in size and weight, they eventually fall to the bottom of the plating tank. These copper fines (often referred to as sanding) thus undesirably consume bath components intended for plating the workpiece, and require replenishment of the bath and the obvious cost penalty associated therewith. Still further, in many situations, the copper fines can result in clogging of devices (e.g., filters) associated with the plating vessel. As a result, periodic cleaning of the vessel may be necessary, again adding time and labor costs to the operation of a plating line.

SUMMARY OF THE INVENTION

The primary object of the present invention is to provide a process for eliminating, or at least substantially minimizing, copper fines which otherwise develop in a plating vessel during the electroless depositing of copper onto activated substrate surfaces using autocatalytic electroless copper depositing baths.

This and other objects as will be apparent from the description which follows are attained by virtue of a process in which an autocatalytic electroless copper plating bath containing copper fines is subjected to a brief application of current between a cathode element and an anode element immersed in the bath, and in which the anode element comprises a generally planar anode surface substantially parallel and proximate to the bottom surface of the vessel or tank in which the electroless copper plating bath is contained. The briefly applied current brings about oxidation of the copper metal of the fines such that it redissolves in the plating bath in the form of a bath-soluble copper compound.

As a consequence of the foregoing invention, copper fines are redissolved in the bath, thus substantially eliminating the need to replenish bath ingredients to the extent otherwise needed to make up for the consumption thereof by copper fine formation, substantially eliminating the possibility of such fines clogging apparatus associated with the plating vessel, and minimizing the frequency with which the plating process must be interrupted in order to remove fines from the plating vessel.

As used herein, an "autocatalytic" electroless copper plating bath is one which is either inherently autocatalytic by virtue of its composition or one which is operable in a manner such that it acts autocatalytically in an electroless copper depositing process.

The generally planar anode surface substantially parallel and proximate to the vessel bottom is preferably arranged so as to actually rest on the vessel bottom, but alternatively can be arranged to reside in a plane a small vertical distance above the vessel bottom. In either case, it is preferred that the planar anode surface be configured and sized so as to occupy (or reside over) a substantial portion of the vessel bottom area, and most preferably will be essentially the same planar dimensions of the vessel bottom. The planar anode surface can consist of a single suitably configured and sized planar surface or multiple surfaces (in essentially the same plane) whose combined planar area serves to satisfy the required anode surface size and configuration. In addition, the planar anode surface substantially parallel and proximate to the vessel bottom can be the sole anode surface in the vessel or, alternatively (and preferably for ease of construction), the anode element can comprise not only the planar anode surface substantially parallel and proximate to the vessel bottom but also other anode surfaces. Thus, for example, the anode element can be conveniently configured in an L-shape having a portion parallel and proximate to the vessel bottom and an integral portion perpendicular thereto.

The process of the present invention can be practiced in a variety of manners and in a variety of stages in an electroless copper depositing process. In one such embodiment, at any particular point in the plating process where the build-up of fines has reached a predetermined undesirable degree, an anode element as described and a cathode element can be inserted in the bath, current applied briefly therebetween to effect redissolution of the copper fines as bath soluble chelated copper compounds, the electrode elements then removed, and plating on a workpiece commenced or recommenced. In such situations, the workpiece can be present in the bath during the oxidation/redissolution and, if so, the workpiece itself (e.g., an initially copper-clad substrate or a substrate on which copper has been deposited from the bath) can serve as the cathode in the circuit. In this latter regard, the invention is particularly easily adapted to autocatalytic copper depositing processes such as disclosed in U.S. Pat. No. 4,671,968. In processes of that type, autocatalytic copper depositing is achieved by brief application of a current to the substrate (i.e., a current of negative potential applied so as to render the substrate workpiece cathodic). By configuring the anode element in accordance with the invention, i.e., in a manner such that the anode element is comprised of a generally planar anode surface substantially parallel to, and proximate to, the vessel bottom, and preferably also having an integral anode surface essentially perpendicular to the vessel bottom (e.g., parallel to the vessel side walls), the briefly applied current used to initiate autocatalytic deposition at the same time effects substantial oxidation/redissolution of copper metal fines in the vessel.

For ease of operation, the anode element according to the invention will be prearranged in the plating vessel and left there during plating operations. Copper fines which fall to the vessel bottom during plating operations will thus fall in contact with the anode surface there and can be readily redissolved by inserting a cathode in the vessel contents (or using a workpiece already immersed therein as the cathode) and then completing an electrical circuit therebetween and briefly applying current. As an alternative, the anode element according to the invention can be immersed in the vessel at or about the time when the redissolution is required, and in such circumstances it may be desirable to agitate or recirculate the vessel contents so that pre-existing fines on the vessel bottom can be briefly disrupted therefrom and then caused to settle on the surfaces of the inserted anode element for redissolution.

In operation in conjunction with a typical electroless plating process, then, the process of the invention may, for example, be employed with an inherently autocatalytic electroless copper depositing bath by first plating one or more suitably activated substrates immersed at one time and/or sequentially in the bath until such time as build-up of copper fines reaches a particular undesirable degree. Then, prior to immersion of the next substrate(s) in the bath, the bath is subjected to the applied current using an anode and cathode either already immersed in the bath or immersed therein for this particular step. Alternatively, the applied current can be imposed with the substrate present in the bath, optionally using the substrate as the cathode. Thereafter, electroless copper plating is continued until such time as copper fines build-up again becomes problematic. The process of the invention may also be used with depositing baths which are only autocatalytic in use after initiation of plating using a briefly applied current. Here, since the applied cathodic current necessarily is imposed before plating on the substrate commences, oxidation/redissolution of copper metal fines will occur incident to initiation of plating of each new load of substrates brought to the plating vessel.

DETAILED DESCRIPTION OF THE INVENTION

As earlier-noted, the electroless copper depositing solutions to which the present invention relates are those of the type comprised of aqueous solutions of a bath-soluble source of copper ions (e.g., copper sulfate), a reducing agent (e.g., formaldehyde or a soluble source of hypophosphite such as sodium hypophophite), a complexing agent for copper ions (e.g., the hydroxy acids and their metal salts such as the tartrates, gluconates, glycolates, lactates and the like, amine-type agents such as N-hydroxyethyl ethylenediamine triacetic acid (HEEDTA), ethylenediamine tetraacetic acid (EDTA), and the like). The bath generally will further comprise pH adjusting agents (acids, bases, buffers) to attain optimum operating pH, and typically will contain further additives for brightening, levelling or other like functions. The baths may also contain additional metal species, such as bath-soluble nickel and/or cobalt compounds which may be required to render the bath autocatalytic. Typical baths are described in U.S. Pat. Nos. 4,209,331 and 4,265,943, incorporated herein by reference.

As is typical, the substrates to be plated in the electroless copper depositing solutions will be pretreated in known manner to clean the surfaces to be plated and to render them catalytically active to electroless deposition, e.g., through use of palladium-tin sols or solutions, with or without acceleration. Where the substrate is one for use in the manufacture of printed circuit boards, through-hole surfaces in the boards optionally will be specially treated in known manner (e.g., in desmearing and/or etch-back processes) to enhance their receptivity to an electroless copper deposit.

Figure 1:
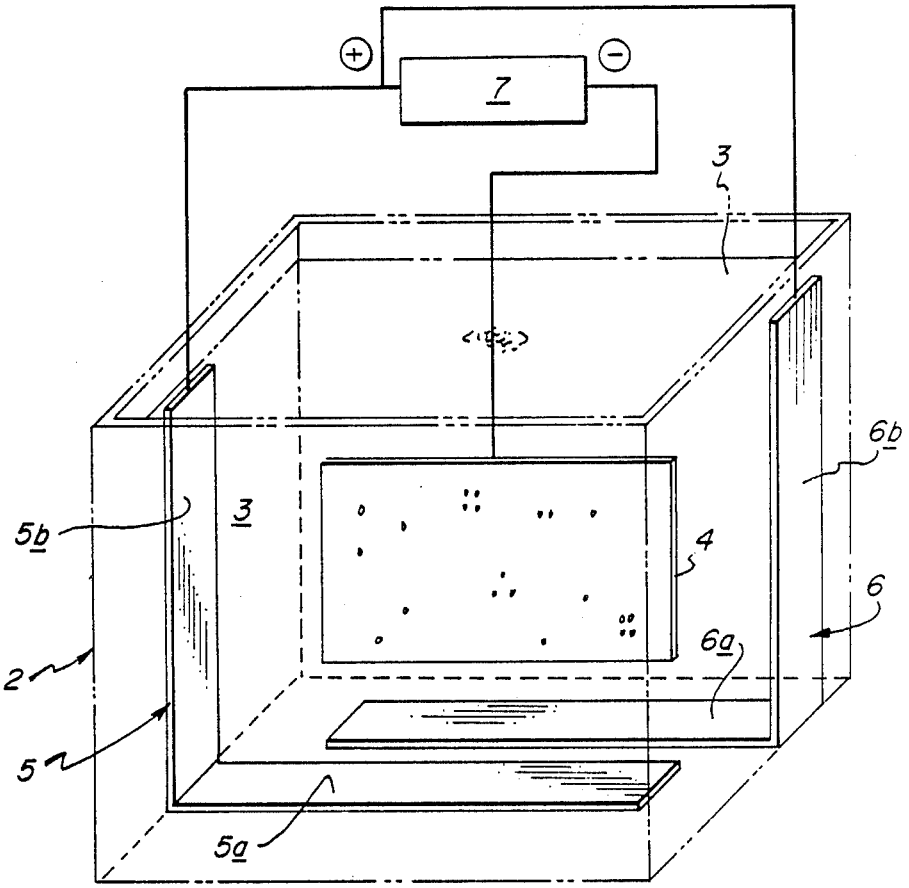
FIG. 1 is a schematic, partially perspective illustration of the interior of an electroless copper plating tank having arranged therein a workpiece and an anode element in accordance with the invention.

Referring to FIG. 1, there is shown schematically a plating vessel 2 containing an electroless copper depositing bath 3. Arranged in the tank and bath is a workpiece 4 to be electrolessly plated. Also arranged in the plating vessel 2 are a pair of anode elements 5 and 6, each comprised of a planar anode surface 5*a* and 6*a*, respectively, which lies on the vessel bottom. As shown, and as is preferred, the combined planar anode surface at the vessel bottom is such as to occupy a substantial portion of the vessel bottom area. As employed in FIG. 1, the planar anode surfaces 5*a* and 6*a* are simply portions of the overall integral anode elements 5 and 6 which are each constructed in L-shape as a convenience and thus also have anode surfaces 5*b* and 6*b*, respectively, which are configured to be substantially parallel and proximate to opposite side walls of the plating vessel 2. Insofar as is strictly required in the present invention for dissolving copper fines, only anode surfaces 5*a* and 6*a* are necessary and thus the anode element can consist solely of such surfaces (which can be adapted for electrical connection to the positive terminal of a current source by means of a suitable insulated conductive cable affixed to the anode surfaces and adapted for immersion in the plating bath). As previously noted, the dimensions per se of the planar anode surfaces are not critical as such, so long as adequate current density can be achieved to effect the oxidation of a substantial portion of the copper metal fines in the vessel and bath and, most preferably, the dimensions of the overall planar anode surface should be such as to occupy (or reside over) most (i.e., greater than about 50%, and preferably greater than about 75%) if not substantially all of the vessel bottom area such that the majority of fines which drop to the vessel bottom will fall upon the anode surface.

As shown in FIG. 1, the anode and cathode elements are provided with means for connecting them to the positive and negative terminals of a suitable rectifier 7.

Figure 2:
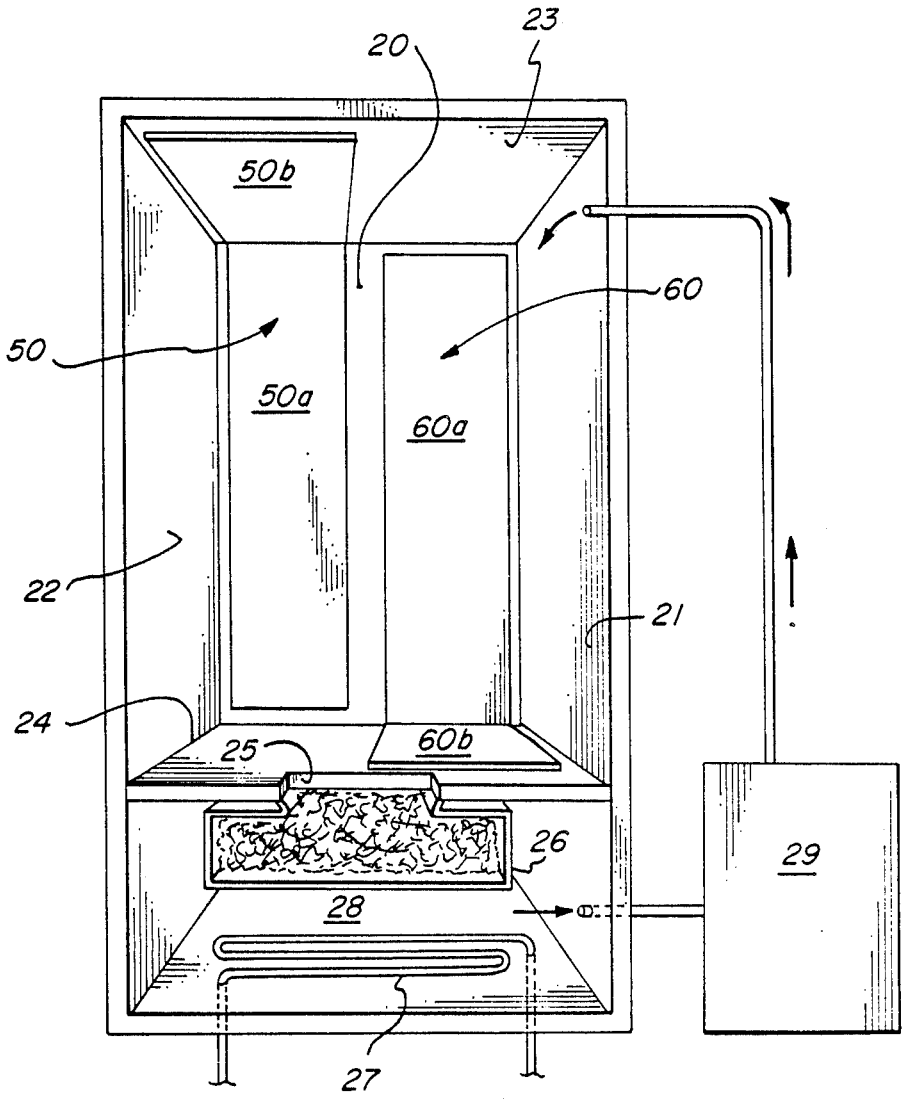
FIG. 2 is a schematic, top view illustration of the interior of an electroless copper plating tank having arranged therein an anode element according to the invention.

In FIG. 2 there is shown an open top view of a plating vessel as is typically encountered in the industry, employing continuous and/or periodic recycling of the plating bath. The plating vessel bottom is designated as 20, and is surrounded by side walls 21, 22, 23 and 24. Side wall 24 has associated with it a weir area 25 through which the plating bath can be removed to a sump area 28 (typically first flowing through a filter bag 26) containing means 27 for heating the bath (e.g., to about 105° F.) and from which the bath can be withdrawn and recirculated via pump 29 back to the plating vessel.

Arranged within the plating vessel are anode elements 50 and 60 essentially as described in FIG. 1, i.e., having planar anode surfaces 50*a* and 60*a* residing on the vessel bottom 20 and anode surfaces 50*b* and 60*b* resting along side walls 23 and 24, respectively.

The anode element according to the invention can be any soluble or insoluble anode, such as copper, carbon graphite, stainless steel, platinized titanium, and the like. Where the substrate workpiece itself is not employed as the cathode element, the immersed cathode can be any suitable material such as copper.

For achieving the oxidation/redissolution of copper metal fines, the bath generally will be maintained at typical operating temperature, and an applied potential of about 1 to 2 volts employed, although a wide variety of conditions are usable so long as they are effective to achieve the oxidation.

For the situations where an applied potential is required to initiate autocatalytic deposition per se, such as in U.S. Pat. No. 4,671,968, the conditions there taught (e.g., applied potential maintained for a time effective to establish a cell potential of at least about −1100 mV between the substrate and the anode, with reference to a standard calomel electrode) generally will at the same time be effective in achieving the oxidation/redissolution of copper metal fines in the plating bath, using the anode configuration of the invention.

The invention is further described and illustrated with reference to the following examples.

EXAMPLE 1

Following the teachings of U.S. Pat. No. 4,671,968, an electroless copper depositing solution was made up at a volume of four (4) liters in a glass beaker, using 1.5 g/l. copper in the form of copper sulfate, 5.0 g/l. sodium hydroxide, 22 g/l. sodium hypophosphite, 50 ppm cobalt in the form of cobalt sulfate and, as complexing agents, Rochelle salts in slight stoichiometric excess over the copper concentration. The bath temperature was adjusted to 105° F. and a copper-clad epoxy printed circuit board substrate with thru-holes, which had been pre-cleaned and catalyzed by immersion in a palladium-tin solution, was immersed in the beaker along with a stainless steel anode arranged essentially perpendicular to the beaker bottom (and essentially parallel to the substrate). The positive terminal of a rectifier was connected to the anode, while the negative terminal was connected to the printed circuit board substrate. The rectifier was turned on and the voltage increased to about 2.0 volts, and then turned off after about two minutes when evidence of electroless deposition appeared (evolution of hydrogen bubbles). After about thirty (30) minutes in the bath, the printed circuit board was removed, having had deposited thereon about 100 microinches of electroless copper.

The foregoing plating sequence was repeated a number of times in simulation of a production plating line, with bath ingredients being replenished as necessary, each such sequence being commenced with the brief application of electric current of negative potential. After a few such sequences, build-up of copper metal fines on the bottom surface of the glass vessel could be observed.

EXAMPLE 2

Using the same bath, conditions and materials as set forth in Example 1, the process was repeated with the exception that the stainless steel anode was configured in L-shape such a portion of the anode surface lay on the bottom of the beaker, i.e., perpendicular to the plane of the printed circuit board. Electroless copper deposition was initiated as in Example 1, and the board removed after about thirty (30) minutes and approximately 100 microinches of electroless copper deposit. The plating sequence was repeated on fresh boards a number of times, each time with initiation via the applied current, and no copper fines were visually apparent on the vessel or anode surfaces. With each application of current to initiate the autocatalytic electroless plating, copper metal fines apparently were oxidized and redissolved in the bath as bath-soluble chelated copper sulfate.

The foregoing description is provided in explanation of the operation and principles of the invention, but is not to be read as limiting the scope of the invention as defined by the appended claims.

What is claimed is:

1. In a process for electrolessly depositing a coating comprised of copper metal onto the activated surfaces of a substrate, wherein said substrate is immersed in an electroless copper depositing bath in a plating vessel having a bottom surface and side surfaces, under conditions effective to autocatalytically deposit a coating comprised of copper metal onto said activated surfaces of said substrate, and during which process metal particles comprised of copper, not adherent to said activated surfaces of said substrate, form in said electroless copper depositing bath, the improvement wherein said metal particles in said electroless copper depositing bath are oxidized and redissolved therein, said improvement comprising arranging said electroless copper depositing bath, containing said metal particles, in a treatment vessel having a bottom surface and side surfaces; arranging in said treatment vessel containing said electroless copper depositing bath a cathode element and an anode element, said anode element comprising a generally planar anode surface essentially parallel and proximate to said bottom surface of said treatment vessel; and briefly applying an electrical current between said anode and cathode elements for a time and at conditions sufficient to oxidize said metal particles so as to enable them to redissolve in said electroless copper depositing bath as bath-soluble compounds.

2. The process according to claim 1 wherein said treatment vessel is said plating vessel.

3. The process according to claim 2 wherein said electroless copper depositing bath comprises an aqueous solution comprised of a soluble source of copper ions, a reducing agent, and a complexing agent.

4. The process according to claim 3 wherein said electroless copper depositing bath is formaldehyde-free and wherein said reducing agent comprises a soluble source of hypophosphite.

5. The process according to claim 3 wherein said reducing agent comprises formaldehyde.

6. The process according to claim 3 wherein said electroless copper depositing bath is inherently autocatalytic.

7. The process according to claim 3 wherein said electroless copper depositing bath is not inherently autocatalytic, and wherein said conditions effective to autocatalytically deposit copper metal onto said activated surfaces of said substrate comprise brief application of electric current of negative potential to said substrate.

8. The process according to claim 3 wherein said anode surface comprises a material selected from the group consisting of copper, carbon graphite, stainless steel, and platinized titanium.

9. The process according to claim 3 wherein said brief application of electrical current between said cathode element and said anode element is conducted in the presence of said substrate.

10. The process according to claim 7 wherein said cathode element comprises said substrate.

11. The process according to claim 2 wherein a single anode element is arranged in said plating vessel.

12. The process according to claim 2 wherein multiple anode elements are arranged in said plating vessel, each comprising a generally planar anode surface essentially parallel and proximate to said plating vessel bottom surface.

13. The process according to claims 11 or 12 wherein said anode element further comprises a generally planar anode surface essentially parallel and proximate to the side surfaces of said plating vessel.

14. The process according to claim 2 wherein said generally planar anode surface rests on said plating vessel bottom surface.

15. The process according to claim 14 wherein said generally planar anode surface occupies greater than about 50% of the surface area of said plating vessel bottom surface.

16. The process according to claim 14 wherein said generally planar anode surface occupies greater than about 75% of the surface area of said plating vessel bottom surface.

17. In a process for electrolessly depositing a coating comprised of copper onto suitably activated surfaces of a substrate material by immersion of said substrate in an electroless copper depositing bath, maintained in a plating vessel having side surfaces and a bottom surface, said electroless copper depositing bath being comprised of an aqueous solution of a soluble source of copper ions, a soluble source of hypophosphite, a complexing agent, and a soluble source of non-copper ions selected from the group consisting of cobalt ions, nickel ions and mixtures thereof, and wherein autocatalytic deposition of electroless copper from said electroless copper depositing bath onto said activated surfaces of said substrate is initiated by brief application of an electric current of negative potential to said substrate to render it cathodic while immersed in said electroless copper depositing bath, using an anode also immersed in said electroless copper depositing bath for completion of the electrical circuit, the improvement comprising utilizing as said anode an anode element comprising a generally planar anode surface substantially parallel and proximate to said plating vessel bottom surface so as to effect oxidation and redissolution in said electroless copper depositing bath of non-adherent metal particles comprised of copper which are formed in said electroless copper depositing bath during said electroless copper depositing process.

* * * * *